United States Patent [19]

Notenboom

[11] 4,083,534

[45] Apr. 11, 1978

[54] LOW NOISE, SELF-LOCKING WINCH

[75] Inventor: Leo J. Notenboom, Kirkland, Wash.

[73] Assignee: Genie Industries, Inc., Kirkland, Wash.

[21] Appl. No.: 712,738

[22] Filed: Aug. 9, 1976

[51] Int. Cl.[2] ..... B66D 1/00

[52] U.S. Cl. ..... 254/186 HC; 188/82.7; 192/12 B

[58] Field of Search ..... 254/163, 164, 150, 186 R, 254/186 HC; 188/82.7, 82.74, 82.77; 192/12 B, 15, 16; 182/5, 103

[56] References Cited

U.S. PATENT DOCUMENTS

| | | | |
|---|---|---|---|
| 1,482,302 | 1/1924 | Hescock | 192/15 |
| 1,482,924 | 2/1924 | Hescock | 192/15 |
| 2,551,309 | 5/1951 | Allison | 188/82.77 X |
| 3,237,732 | 1/1966 | Hayes | 188/72.5 X |
| 3,281,043 | 10/1966 | Plumb | 188/82.7 X |
| 3,288,254 | 11/1966 | Replogle | 188/82.7 X |
| 3,809,196 | 5/1974 | Moribe | 192/12 B |

FOREIGN PATENT DOCUMENTS

| | | | |
|---|---|---|---|
| 1,159,259 | 2/1958 | France | 188/82.7 |
| 351,539 | 5/1921 | Germany | 188/82.7 |

*Primary Examiner*—Drayton E. Hoffman

*Assistant Examiner*—Donald W. Underwood

*Attorney, Agent, or Firm*—Seed, Berry, Vernon & Baynham

[57] ABSTRACT

A low noise, self-locking winch with a cylindrical cable drum having a cable wound around its periphery. The drum is rotated by a drive wheel which is fixedly mounted on a drive shaft. A latch wheel, having a smooth outer periphery, is slidably mounted on the drive shaft adjacent the drive wheel with a layer of frictional braking material positioned therebetween such that axial pressure on the latch wheel with respect to the drive shaft causes the latch and drive wheels to rotate as a unit. A crank is threaded onto the end of the drive shaft adjacent the latch wheel so that rotation of the crank in a winding direction forces the latch wheel against the drive wheel to rotate the cable drum. A pivotally mounted latch lever is resiliently biased against the smooth outer periphery of the latch wheel in a manner that causes the latch lever to cam against the latch wheel as the drum rotates in an unwinding direction thereby locking the winch. Cable is unwound from the drum by rotating the handle to release the pressure of the latch wheel against the drive wheel thereby allowing the drive wheel to rotate free of the stationary latch wheel.

3 Claims, 3 Drawing Figures

LOW NOISE, SELF-LOCKING WINCH

BACKGROUND OF THE INVENTION

1. Field of the Invention

This invention relates to winches, and, more particularly, to a hand operated, self-locking winch which is relatively silent in operation.

2. Description of the Prior Art

Hand operated winches are used in a wide variety of applications for forcibly retracting a cable, rope or other elongated member. Very often the load at the end of the cable exerts a constant force away from the winch so that the winch crank must be held immobile in order to prevent cable from unwinding from the cable drum. In order to prevent the cable from unwinding from the winch, latching mechanisms are frequently utilized to prevent rotation of the cable drum. These mechanisms generally include a pawl resiliently biased against the teeth of a ratchet wheel mounted on the cable drum. The pawl is lifted from the ratchet wheel in order to allow unwinding of cable from the drum. One surface of the pawl is generally beveled to allow the teeth of the ratchet wheel to move beneath the pawl in one direction while preventing the wheel from rotating in the opposite direction. As cable is wound on the drum, the pawl sequentially climbs over the teeth of the ratchet wheel and, after each tooth has been cleared, forcibly strikes the next adjacent tooth. Thus, as the pawl clears each tooth of the ratchet wheel, a relatively loud noise is produced. In many applications, such as in the construction industry, this noise is not particularly objectionable. However, in other applications, such as in hospitals, office buildings and other environments where it is desirable to keep noise at a minimum, winches using such latching mechanisms are unacceptable.

One of the primary advantages of conventional pawl and ratchet latching mechanisms is that they are both inexpensive and effective. The mechanism includes only three parts — a ratchet wheel, a pawl and a spring. Furthermore, the strength of the latching mechanism can be adjusted easily simply by scaling up the size of the rattchet and pawl. Thus, except for the noise problem, winches using pawl and latching mechanisms are extremely efficient and inexpensive devices.

SUMMARY OF THE INVENTION

It is an object of the invention to provide a self-latching winch which restrains a cable drum from rotating in a cable unwinding direction and is silent while allowing the drum to rotate in a cable winding direction.

It is still another object of the invention to provide a low noise, self-latching mechanism which is capable of preventing drum rotation even in the presence of relatively large rotational torques.

It is a further object of the invention to provide a latching mechanism which is easily implemented on commercially available ratchet winches in order to readily convert a conventional ratchet winch into a relatively quiet, self-latching winch.

These and other objects of the invention are accomplished by a latch mechanism including a latch wheel coupled to a cable drum so that the drum rotates in accordance with rotation of the latch wheel. The latch wheel has a smooth, outer surface against which a pivotally mounted latch lever is resiliently biased. The wheel engaging end of the latch lever is curved so that rotation of the latch wheel in a cable unwinding direction causes the lever to cam against the latch wheel with increasing force while rotation of the latch wheel in a cable winding direction causes the latch lever to move away from the smooth periphery of the latch wheel. Thus, the latch mechanism restrains the drum from rotating in a cable unwinding direction and is substantially silent while the drum is rotating in a cable winding direction.

DETAILED DESCRIPTION OF THE INVENTION

Figure 1:
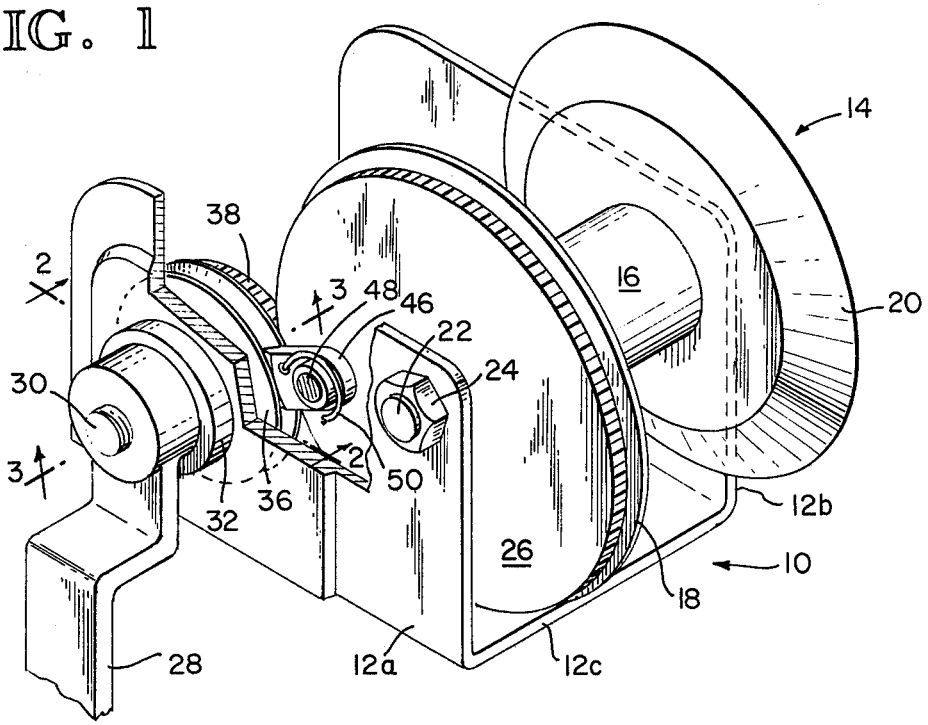
FIG. 1 is an isometric view of the low noise, self-latching winch with a portion of the winch frame broken away for illustrative purposes.

The overall winch structure is illustrated in FIG. 1. The winch 10 includes a generally U-shaped frame 12 having two side sections **12*a*,12*b* and a center section 12*c*. The center section 12*c* is preferably mounted on a trailer or lift (not shown). A cable drum 14, having a cylindrical spool 16 with annular guides on opposite sides 18,20 is rotatably mounted in the frame 12 by a bolt 22 extending from one side 12*b* to the opposite side 12*a* of the frame and secured in place by a nut 24. A spur gear 26 is coaxially secured to the guide 18 so that the gear 26 rotates with the drum 14**.

Figure 3:
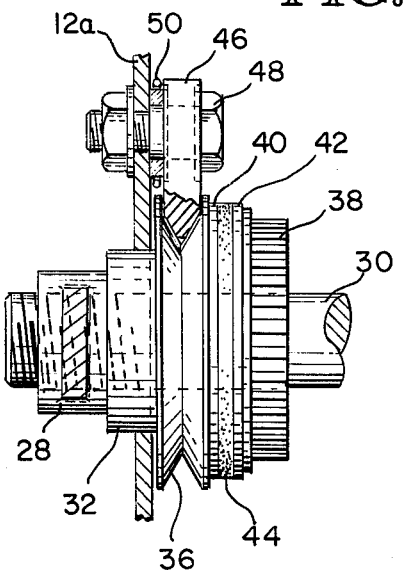
FIG. 3 is a cross-sectional view of the latching mechanism taken along the line 3—3 of FIG. 1.

The drum 14 is rotated by a crank 28 which is threaded onto the end of a drive shaft 30 so that rotation of the crank 28 with respect to the shaft 30 moves the shaft axially for the purpose of actuating and releasing a braking mechanism as described hereinafter. The drive shaft 30 is rotatably mounted in the frame 12 by conventional bearings 32 fixedly secured to the sides of the frame **12*a*,12*b*, respectively. A latch wheel 36 is slidably mounted on the drive shaft 30 between the sides of the frame 12*a*,12*b*, and a drive wheel 38 having a plurality of teeth spaced apart around its periphery is fixedly secured to the shaft 30. The teeth of the wheel 38 engage the teeth of the gear 26 so that the drum 14 rotates in accordance with the rotation of the shaft 30. The wheels 36,38 each contain opposed planar braking plates 40,42, respectively, positioned on opposite sides of a sheet of frictional braking material 44 (FIG. 3). As the crank 28 is rotated in a clockwise position and screws the shaft axially, the drive wheel 38 also moves axially with respect to the fixed frame 12 and crank 28 thereby compressing the frictional braking material 44 between the braking plates 40,42 so that the wheels 36,38 rotate together as a unit with the drive shaft 30**.

Figure 2:
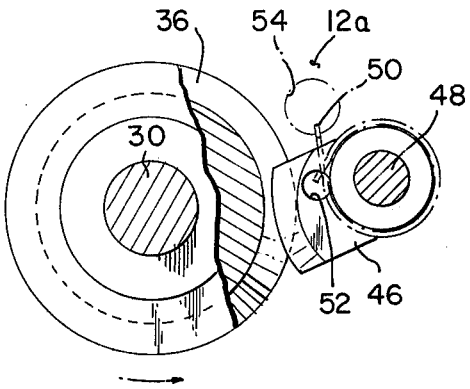
FIG. 2 is a side elevational view of the latching mechanism partially in section.

The low noise, self-locking winch includes a latching mechanism illustrated in greater detail in FIGS. 2 and 3. A latch lever 46 is pivotally secured to the frame sidewall **12*a* by a shoulder bolt 48 and is resiliently biased against the periphery of the latch wheel 36 by a spring member 50 extending between an aperture 52 in the latch lever 46 and an aperture 54 in the frame side 12*a*. The end of the latch lever 46 engaging the periphery of the latch wheel 36 is curved such that rotation of the latch wheel 36 in a cable unwinding direction, indicated by the arrow in FIG. 2, causes the latch lever 46 to exert a greater force against the periphery of the wheel 36** thereby increasing the latching force. Rotation of the latch wheel 36 in a cable winding direction allows the latch lever 46 to pivot away from the latch wheel 36 so that the latch wheel 36 rotates without producing an undue amount of noise. The end of the latch lever 46 may be curved in any manner which causes the latch lever 46 to cam against the latch wheel 36 with increasing force as the wheel 36 is rotated in a cable unwinding direction. However, the latch lever 46 illustrated in the drawings has a cylindrical periphery with a center of curvature offset beneath and toward the wheel 36 with respect to the pivot axis of the latch lever 46.

As best illustrated in FIG. 3, the periphery of the latch wheel 36 contains a V-shaped groove extending around its circumference. The end of the latch lever 46 has a truncated V-shaped cross section corresponding to the V-shaped groove in the latch wheel 36. Thus, increasing latch forces exerted on the latch wheel 36 by the latch lever 46 compresses the latch lever 46 thereby maintaining the force of the latch lever 46 against the sidewalls of the groove in the latch wheel 36. The outer edge of the latch lever 46 is truncated or flatened to allow the beveled sides of the latch lever 46 to freely contact the beveled sides of the latch wheel 36 without the end of the lever 46 contacting the center of the wheel 36 at the junction of the beveled surfaces of the wheel 36.

The winch may be fabricated from a wide variety of materials including plastic or metal. The latch lever 46 must, of course, have sufficiently axial rigidity to withstand the forces exerted on it by the latch wheel 36.

In operation the crank 28 is rotated in a cable winding direction thereby moving the shaft 30 axially and forcing the braking plate 42 of the drive wheel 38 against the braking plate 40 of the latch wheel 36 and compressing the frictional braking material 44. As rotation of the crank 28 continues, the shaft 30, latch wheel 36 and drive wheel 38 subsequently rotate as a unit thereby rotating the drum 14 through spur gear 26. When the crank 28 is subsequently released, the latch lever 46 prevents the latch wheel 36 from rotating under the weight of the load, and the braking force exerted on the drive wheel 38 through the braking material 44 prevents the drive wheel 38 and, hence, the drum 14 from rotating. Thus, the winch 10 remains in a locked condition so that cable does not unwind from the drum 14 responsive to axially forces on the cable. When it is desired that cable be unwound from the drum 14, the crank 28 is rotated in the opposite direction thereby allowing the shaft 30 to move axially inward and decompress the braking material 44. As the crank 28 continues to rotate, the braking force exerted on the drive wheel 38 by the stationary latch wheel 36 is reduced until the latch wheel 38, and hence the drum 14, subsequently become free to rotate thereby allowing cable to be unwound from the drum 14. The braking action of the winch re-occurs as soon as the crank 28 stops rotating since rotation of the drum 14, and hence the shaft 30 through the drive wheel 38, causes the shaft 30 to move axially thereby compressing the braking material 44 and allowing the stationary latch wheel 36 to restrain rotation of the drive wheel 38. Thus, in order to unwind cable from the drum 14 crank 28 must be continuously rotated.

The winch may be fabricated by modifying a conventional winch such as Model 945 sold by the Fulton Manufacturing Corporation of Milwaukee, Wisconsin. This conventional winch, which is fully described in the Fulton catalogs which are incorporated herein by reference, includes a ratchet wheel instead of the latch wheel 36 and a pawl instead of the latch lever 46. In order to modify the conventional ratchet winch into the inventive low noise, self-locking winch, the ratchet wheel and pawl are removed from the frame of the Fulton winch leaving a pair of mounting apertures. The latch wheel 36 is then installed on the shaft 30 in place of the ratchet wheel and the latch lever 46 is pivotally mounted to the frame 12*a* by the bolt 48 extending through one of the existing mounting apertures in the frame. The spring 50 is then placed between the hole 52 in the latch lever 46 and the other mounting aperture 54 in the frame 12*a*.

The embodiments of the invention in which a particular property or privilege is claimed are defined as follows:

1. A low noise, self-locking winch, comprising:

a rigid winch frame;

a cylindrical drum rotatably mounted in said winch frame, said drum being adapted to receive a cable wound around its periphery;

a crank mounted on a drive shaft, said shaft being rotatably mounted on said frame;

transmission means for coupling said drive shaft to said drum such that rotation of said shaft rotates said drum;

a latch wheel mounted on said drive shaft, means for restricting rotation of said latch wheel with respect to said drive shaft, said latch wheel having a generally V-shaped groove extending around its outer periphery; and a latch lever having a first end pivotally secured to said frame and a second end resiliently biased against the periphery of said latch wheel, the periphery of said second end having a center of curvature offset from the pivot point of said lever such that the force of said lever against said latch wheel smoothly increases as said drum rotates in a cable unwinding direction; said second end having an outwardly projecting generally V-shaped cross section adapted for insertion into the V-shaped groove of said latch wheel such that the area and depth of contact between said latch wheel and latch lever increases and the second end of said latch lever is compressed by said latch wheel during operation as said drum rotates in a cable unwinding direction.

2. The winch of claim 1, wherein the outer periphery at the second end of said latch lever is truncated to prevent said lever from contacting the center portion of said groove as said latch lever forcibly contacts said latch wheel.

3. The winch of claim 1 wherein said transmission means include a drive wheel which is fixedly secured to said drive shaft and engaging said drum, said latch and drive wheels each having adjacent brake surfaces separated by a sheet of frictional braking materials and wherein said crank is threaded onto the end of said drive shaft adjacent said latch wheel such that rotation of said crank in a cable winding direction forces said brake surfaces together such that said crank rotates said latch and drive wheels as a unit, the frictional forces between said latch and drive wheels preventing said drive wheel from rotating in a cable unwinding direction until said crank is rotated in a cable unwinding direction thereby releasing the braking pressure of said drive wheel against said latch wheel so that said drive wheel may rotate in a cable unwinding direction with respect to said stationary latch wheel.

* * * * *